United States Patent [19]

Keim

[11] Patent Number: 5,010,927

[45] Date of Patent: Apr. 30, 1991

[54] HOLD-DOWN DEVICE FOR JACQUARD-CONTROLLED LOOMS

[75] Inventor: Walter Keim, Senden, Fed. Rep. of Germany

[73] Assignee: Grosse Webereimaschinen GmbH, Burlafingen, Fed. Rep. of Germany

[21] Appl. No.: 295,593

[22] Filed: Jan. 10, 1989

[51] Int. Cl.[5] ..... D03C 3/24

[52] U.S. Cl. ..... 139/89

[58] Field of Search ..... 139/89, 87, 85, 86, 139/59, 65

[56] References Cited

U.S. PATENT DOCUMENTS

| | | | |
|---|---|---|---|
| 3,371,687 | 3/1968 | Stead | 139/85 X |
| 3,724,513 | 4/1973 | Kohl . | |

FOREIGN PATENT DOCUMENTS

| | | | |
|---|---|---|---|
| 0094270 | 11/1983 | European Pat. Off. | 139/89 |
| 0155004 | 9/1985 | European Pat. Off. | 139/89 |
| 52315 | 12/1966 | Fed. Rep. of Germany . | |
| 2640726 | 10/1978 | Fed. Rep. of Germany . | |
| 132799 | 11/1978 | Fed. Rep. of Germany . | |
| 3524569 | 1/1987 | Fed. Rep. of Germany . | |
| 3728513 | 3/1989 | Fed. Rep. of Germany | 139/89 |
| 2220609 | 10/1974 | France . | |
| 1122703 | 8/1968 | United Kingdom . | |
| 2130255 | 5/1984 | United Kingdom | 139/89 |

*Primary Examiner*—Andrew M. Falik

*Attorney, Agent, or Firm*—Scully, Scott, Murphy & Presser

[57] ABSTRACT

A hold-down device for Jacquard controlled loom machines including a resilient element which exerts a spring force on the hook which is attached to the heald of the machine. The hold-down device is arranged between the hook cord and the cord assembly. The spring force provided by the resilient element is determined by the stroke of the Jacquard machine. Where it is desired for the device to be retrofitted to a Jacquard controlled loom machine, a plurality of resilient elements may be arranged in a matrix between two perforated plates, with springs being arranged in guide tubes and a stop member being attached to the cord assembly. The unit formed by the plurality of resilient elements can be arranged at an adjustable height between the frame of the Jacquard machine and the loom.

14 Claims, 3 Drawing Sheets

HOLD-DOWN DEVICE FOR JACQUARD-CONTROLLED LOOMS

BACKGROUND OF THE INVENTION

1. Field of the Invention

The invention relates to a hold-down device for Jacquard-controlled looms.

2. Discussion of the Prior Art

With arrangements of this kind the individual warp threads are moved by means of cord assemblies between an upper and a lower position to form the shed. By means of a pull-down device exerting spring force the warp threads or the lower end of the cord assembly are prestressed towards the frame of the machine in the lower shed position. Lifting the warp thread and the cord assembly into the upper shed position is achieved by control of the hooks of a Jacquard machine according to a pattern, the lower end of the hooks of the Jacquard machine being directly, and usually releasably, connected to the upper end of the cord assembly by means of a hook cord. In the lower shed position the respective hook of the Jacquard machine is supported on a bottom board, and in the upper shed position, when controlled, the hook is held by means of a suitable arresting device. A large number of systems for controlling the hooks of a Jacquard machine according to a pattern are known and used commercially, for example mechanical and electromechanical systems.

Generally the lower ends of all the hooks of a Jacquard machine have a different geometric spatial arrangement than the points of engagement of the cord assemblies with the warp threads, so that guides are necessary for the cord assemblies, which result in different amounts of friction. Furthermore it is usual to lift or to lower a plurality of warp threads by means of one hook, i.e. to provide a plurality of hook cords and cord assemblies. When weaving with a pattern repeat in this way up to 10 cord assemblies can be controlled by means of one hook, so that a correspondingly greater force is exerted on the hook by the plurality of pull-down devices. The number of cord assemblies arranged in a pattern repeat can alter from one piece of weaving to another. There are thus different loads depending on the job. If, however, the force exerted by the pull-down device is too great, wear is high. The desired harness life, the operating time of the loom with a Jacquard machine, is thereby reduced.

If on the other hand the force exerted by the pull-down device is too low operational difficulties can result. These disadvantages become greater at faster operating speeds since at a higher speed of rotation of the drive for the Jacquard machine the hooks are moved at greater speeds and also have to be returned by the spring force.

The difficulty therefore lies in combining the requirements of the weaving process and the mechanical requirements so as to keep the harness life as high as possible.

If the force exerted on the hook was too low, craftsmen sometimes also stretched a spring between the hook and the frame of the machine. For constructional reasons, and because of the inaccessibility of the numerous hooks in a Jacquard machine, this was only done occasionally, and furthermore was only possible with hooks at the outside.

Different loads on the weaving machine can occur depending on the application for which the weaving is performed. A requirement of weaving technology lies in the fact that the spring force of the pull-down device must always be sufficiently high in order to prevent operational disturbances, such that the force of the pull-down device must be sufficiently high in order to enable the machine to operate efficiently at any rate that the hook is pulled back. On the other hand, a mechanical requirement for the machine must be met, in order to prevent excessive wear which may occur in the case of excessive exertion of force. This disadvantage is particularly serious if the machine is operated with a pattern repeat, that is to say, if more than one cord assembly is controlled by means of a single hook. In addition, the Jacquard loom shall be designed such that by means of retrofitting the machine during standstill, a changing number of cord assemblies may be controllable by means of one hook, thus efficient operation of the machine is insured while wear is reduced even at high speeds.

SUMMARY OF THE INVENTION

On this basis it is an object of the invention to design a hold-down device of the above-mentioned kind so that the weaving and mechanical requirements can be fulfilled in such a way that a long harness life is, attainable.

The present invention provides for the arrangement of an additional resilient element, such as a spring, in the path of the cord assemblies of the Jacquard machine so that a conventional pull-down device must only meet the physical requirements of movement associated with the weaving pattern performed by the machine, while the additional resilient element fulfills the mechanical demands required of the cord assembly during the weaving process performed by the Jacquard machine. The present invention reduces frictional forces on the pull-down device, and prevents excessive wear on the pull-down device through the provision of the additional resilient element in the assembly of the cord mechanism. The constructional features of the present invention also enable improvements to be made in the Jacquard machine by which simple addition of resilient elements, to allow for existing systems to be retrofitted.

BRIEF DESCRIPTION OF THE DRAWINGS

The invention will be explained in more detail with reference to the exemplary embodiments shown in the drawings, in which.

DETAILED DESCRIPTION OF PREFERRED EMBODIMENTS OF THE INVENTION

Figure 1:
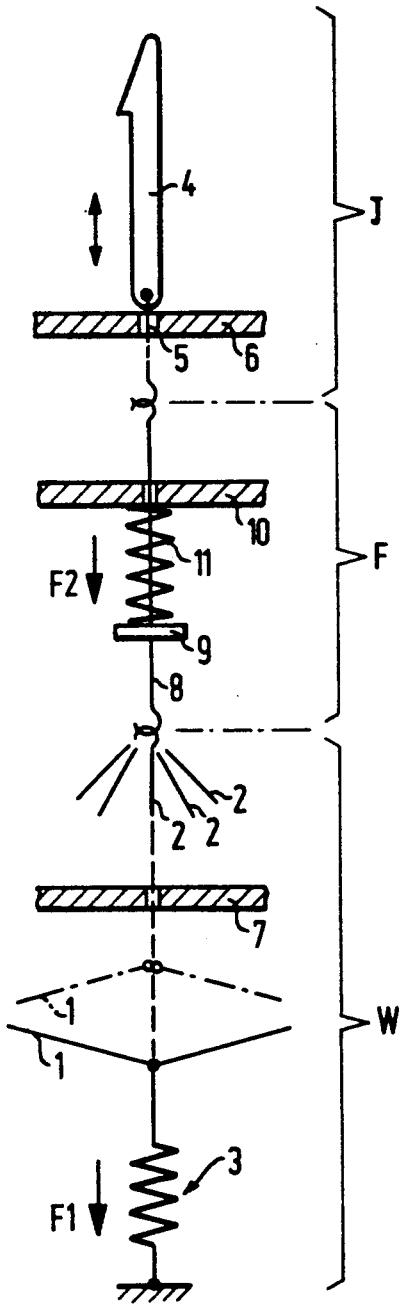
FIG. 1 illustrates diagrammatically the construction of a pull-down device according to the present invention.

FIG. 1 shows in outline the construction of a Jacquard machine J and how it is associated with a loom W. In the loom W running warp threads 1 can be moved by a respective cord assembly 2 between a lower position (lower shed) shown by a full line and an upper position (upper shed) shown by a broken line so that the shed is formed. To hold the warp threads 1 in the lower position a spring force F1 acting towards the machine frame (shown diagrammatically) is exerted on the cord assembly 2 by means of a pull-down device 3 (shown diagrammatically by a spring) in the region in which it lifts or lowers the warp threads 1. If the cord assembly 2 is moved into the upper position shown by the broken line the pull-down device exerts a force tending to return it to the lower position, shown in full lines.

The Jacquard machine J effects the movement of the warp threads 1. In the Jacquard machine J hooks 4 are moved in the usual manner, according to a pattern, between upper shed and lower shed positions and, depending on the control, are held in one of the positions. Each hook 4 is connected securely but releasably to at least one cord assembly 2 of the loom W by a hook cord 5, for example by engagement between a snap-hook or carabiner and an eye which are secured or formed at the respective ends of the hook cord 5 and the cord assembly 2. The control as to whether the hook 4 is to be arrested in the upper shed position or to be left in the lower shed position can be performed in a known manner, for example by way of a mechanical needle mechanism or an electromagnetically controlled holding mechanism or the like. A large number of systems of this kind are known commercially.

In the lower shed position the lower end of the hook 4 usually bears against a bottom board 6 of the Jacquard machine J which is fixed in the machine frame.

FIG. 1 merely indicates that a hook 4 can be joined to a plurality of cord assemblies 2, forming a pattern repeat. Arrangements of this kind are known and conventional.

It is also shown diagrammatically that the cord assembly 2 runs through guides which are also securely fixed to the machine frame. There is no need for these guides to be arranged vertically one above another: rather this is the exception.

The return force which is exerted on the hooks and on the warp threads must satisfy both weaving and mechanical requirements. If this spring force is too high, wear is too high, while if the spring force is too low functional problems can occur. The more often the number of cord assemblies arranged in the pattern repeat is altered, the more serious this is.

This problem is solved by providing a resilient element unit F. As shown in FIG. 1 this unit F has a heald or heddle 8 which can be connected securely but releasably to the hook cord 5 at one end and the cord assembly 2 at the other. This heald 8 securely carries a stop 9. Between the stop 9 and a perforated plate 10 connected to the machine frame is a resilient element 11 which exerts a spring force F2. The spring force F2 exerted by the resilient element 11 is made such that it sufficies to pull the hook 4 down. In contrast to this, the spring force F1 of the pull-down device 3 is made such that it suffices to pull a warp thread 1 down into the lower shed position when the associated hook 4 is in its lower shed position.

The force F1 necessary for the pull-down device 3 is thus determined by the weaving process, and the spring force F2 that must be exerted by the resilient element 11 is determined by the operating perameters of the Jacquard machine of which the device is an element, independently of how many cord assemblies 2 there are in the pattern repeat in the loom W and thus have to be lifted or lowered by means of the hook 4. These operating parameters of the Jacquard machine include the weaving pattern, the distance the heald 8 must travel, etc.

Figure 2A:
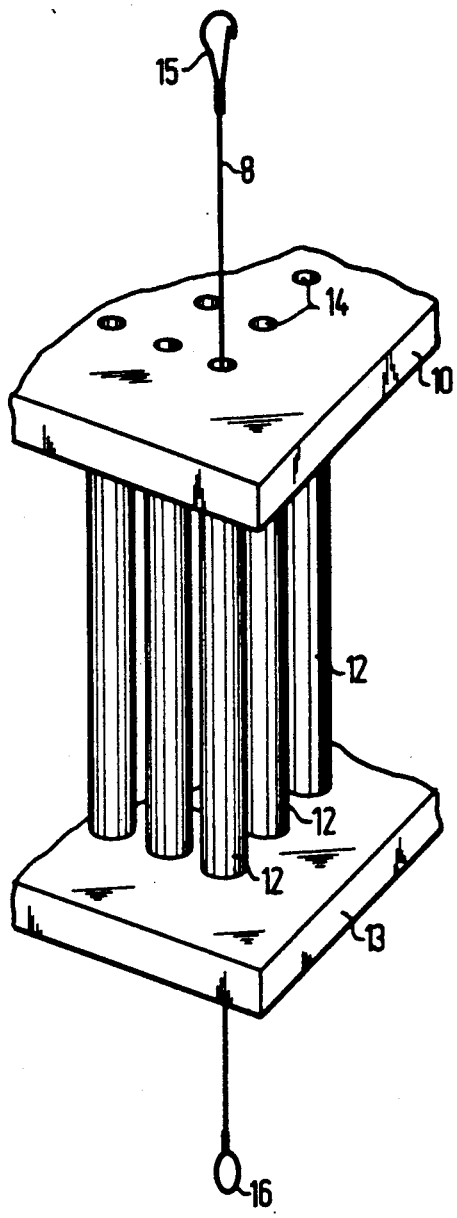
FIG. 2*a* illustrates in cross-section a perspective view of the arrangement of the resilient elements according to the invention in a unit of the Jacquard machine.
Figure 2B:
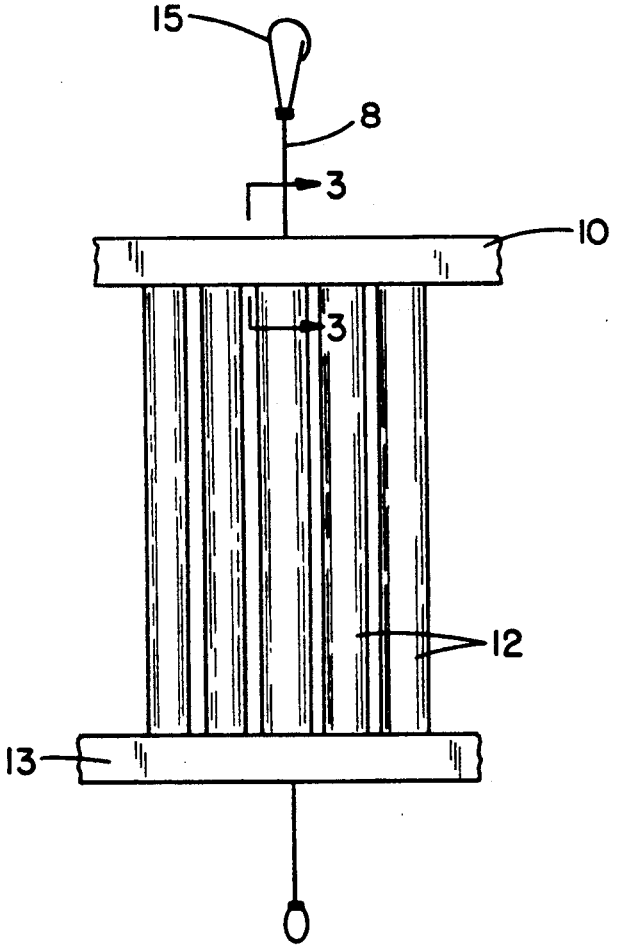
FIG. 2*b* illustrates a plan view of the cross-section view of FIG. 2*a;*

Since for a Jacquard machine J and a loom W many such resilient elements 11 have to be arranged in a matrix similar to the arrangement of the hooks 4, it is advantageous to provide guide tubes 12 in the same matrix arrangement, as shown diagrammatically in FIG. 2, a guide tube 12 being provided for a resilient element 11, a heald 8 and a stop 9. This guide tube 12 is secured between an upper plate, namely the perforated plate 10, and a further plate which is also a perforated plate 13. The guide tube 12 can be relatively thin-walled if the two plates 10, 13 are supported at a predetermined distance apart in the machine frame. FIGS. 2*a*–2*b* shows an embodiment in which the holes 14 in the plate 10 necessary for the passage of the heald 8 (and corresponding holes in the other plate 13) are arranged in a substantially square grid. Depending on the arrangement of the hooks 4 in the Jacquard machine J, the holes 14 of adjacent rows can also be offset from one another. The arrangement can go so far that adjacent guide tubes 12 touch one another. The heald 8 shown in FIG. 2 has a carabiner 15 at its top end and an eye 16 at its bottom end; the arrangement can however be inverted, depending on the fittings on the hook cord 5 and the cord assembly 2.

Figure 3:
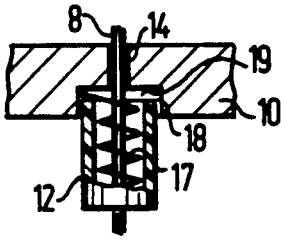
FIG. 3 illustrates a cross-sectional view of a part of a first embodiment along Lines 3—3 of FIG. 2*b;*

FIG. 3 shows an arrangement by means of which the resilient element, in the form of a coil spring 17, is supported in the region of the perforated plate 10. The hole 14 for the passage of the heald 8 essentially has only a slightly larger diameter than the heald 8. On the guide tube 12 side, however, there is a depression 18 whose diameter corresponds to the external diameter of the guide tube 12. The last turn of the coil spring 17 is securely clamped between the end of the guide tube 12 and floor 19 of the depression 18 so that it cannot be pushed or pulled out as the spring moves.

Figure 4:
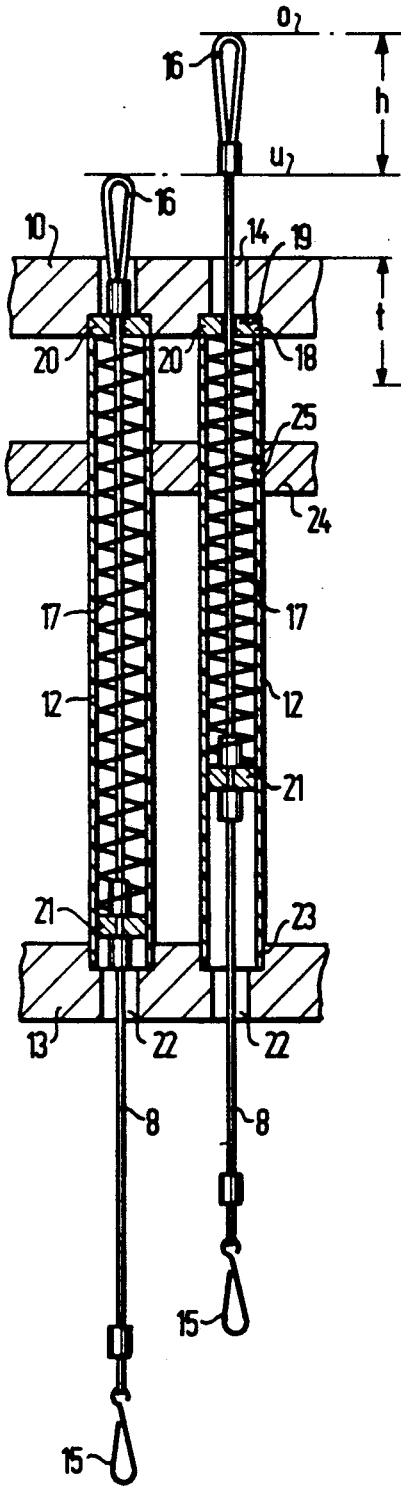
FIG. 4 illustrates a cross-sectional view of a second embodiment of the device shown in FIG. 2*b*.

FIG. 4 first shows the arrangement of the resilient element in the guide tube 12 and in addition an embodiment which differs in respect of the support of the resilient element against the perforated plate 10. First of all, the size of the holes 14 in the perforated plate 10 is such that the eye 16 (or the carabiner 15 in the inverted arrangement) can also enter. Eye 16 connects to hook 4 while carabiner 15 connects to a weaving needle of the Jacquard machine (not shown). Furthermore a depression 18 is also provided on the other side to receive the respective end of the guide tube 12. However, a perforated disc 20 whose hole is only suitable for the passage of the heald 8 is inserted between the guide tube 12 and floor 19 of the depression 18. The perforated disc therefore serves as a supporting element for the resilient element, which is likewise in the form of a coil spring 17.

FIG. 4 further shows that a stop in the form of a disc 21 is clamped on to the heald 8 within the guide tube 12. The external diameter of the disc 21 substantially matches the internal diameter of the guide tube 12 and can in addition have air passages. The disc 21 can therefore also be star-shaped or the like. It is only essential that the disc 21 can be guided within the guide tube 12 and can serve to support the coil spring 17.

At its other end the guide tube 12 is secured in a similar manner in the other perforated plate 13. However, support for the resilient element is no longer necessary, so that it suffices to provide a hole 22 equivalent to the hole 14 and a depression 23 equivalent to the depression 18.

In order to prevent the resilient element arrangement comprising the guide tube 12, coil spring 17 and disc 21 from buckling, particularly in the case of a thin-walled guide tube 12, when the coil spring 17 is compressed, it is advantageous to provide a perforated support plate 24 which has corresponding through holes 25 corresponding to the external diameter of the guide tube 12. In the exemplary embodiment shown this perforated support plate 24 is arranged substantially where the middle of the compressed spring 17 is located, i.e. in about the upper third of the space between the two perforated plates 10 and 13. As is shown in FIG. 5 this perforated support plate 24 is advantageously connected via a bolt connection 26 (not shown in detail) to the lower perforated plate 13.

As already explained above the hook 4 (FIG. 1) is moved between a lower and an upper position; in the lower position the lower end of the hook 4 comes to bear against the bottom board 6 and thereby also determines the lower position of the heald 8. As shown in FIG. 4 the arrangement is such that in this lower position u the eye 16 lies almost unstressed on the disc 20 (or on the perforated plate 10 in the embodiment as shown in FIG. 3). In the upper position o of o the heald 8, which corresponds to the upper stroke position of the hook 4, the maximum spring force F2 is exerted. This stroke h between the lower position u and the upper position o is determined by the machine.

Figure 5:
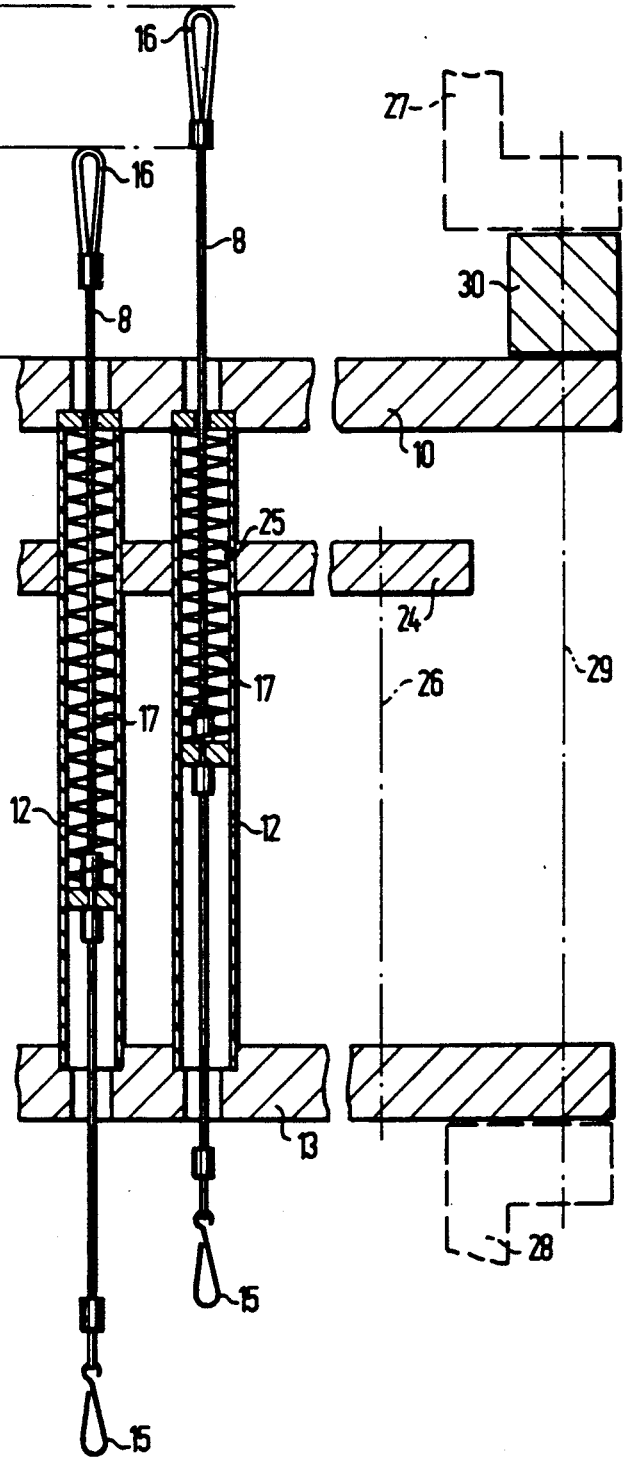
FIG. 5 illustrates a cross-sectional view of the second embodiment of FIG. 4 as arranged in a machine frame, so that additional prestressing may be applied.

FIG. 5 shows essentially the same arrangement as FIG. 4 with the unit F, comprising the two perforated plates 10 and 13 and the resilient elements arranged between them, arranged in the machine frame. FIG. 5 shows diagrammatically an upper frame part 27 which is associated with the Jacquard machine J as shown in FIG. 1, and a lower frame part 28 which is associated with the loom W. The unit F is secured between these by means of a bolt connection 29, indicated only in outline. This shows that the arrangement according to the invention can also be retrofitted to existing Jacquard machine/loom systems.

Furthermore FIG. 5 shows, in contrast to FIG. 4, another spatial position, namely with the unit F set at a distance t lower than the position shown in FIG. 4 by arranging a distance piece 30 having the thickness t between the upper frame part 27 and the perforated plate 10. By suitable selection of the thickness of this distance piece 30 prestressing can additionally be produced in the lower position u and the upper position o, i.e. in this manner the spring force F2 can be made different with the same coil spring 17. It is to be noted that the representation in FIG. 5 shows the eyes 16 of the healds 8 prior to being connected to the respective associated hook 4 by means of the hook cords 5 as shown in FIG. 1.

An arrangement in which the position of the resilient element unit F can be arranged adjustably between the two frame parts 27, 28 is also possible.

The invention has been described with reference to an embodiment in which the coil spring 17 is compressed in the upper position and a compressive force F2 is exerted on the heald 8 by way of a disc 20 which acts downwards. The arrangement can however be such that in the upper position o the resilient element is pulled apart and thus the spring force F2 acts as a tractive force downwards. Furthermore, springs other than coil springs can also be used.

It is found that each hook 4 thus has associated with it a force F2 by means of which it is pulled back into the lower position u as required by the machine, while the force F1 required by the weaving only acts on the warp threads 1 to move these into the lower shed position. Thus on the one hand the functioning of the whole arrangement is ensured while on the other hand wear is reduced even at high speeds (high speeds of rotation of the motor driving the Jacquard machine J). This is even independent of whether the machine is operated with a pattern repeat. This leads to an increase in the harness life as a whole and furthermore simple construction is achieved. In particular retrofitting is possible.

What is claimed is:

1. A hold-down device for Jacquard-controlled loom machines, said machine having needles for weaving, in which warp threads are movable in a pattern between two shed positions under control of the Jacquard machine by means of a cord assembly and a pull-down device connected to a frame of the machine, said pull-down device including a spring force exerting means and being further connected at one end to said cord assembly to exert said spring force thereon, comprising:

a cord releasably attached to another end of the cord assembly and connected to a respective needle of the Jacquard machine, said cord being pulled downwards against a lifting movement of the needles, and a resilient element arranged releasably between the hook cord and the cord assembly, wherein the spring force exerting means is constructed to apply said spring force according to predetermined parameters of a weaving process for which the device is used, and said resilient element has a spring force that corresponds to the force required by the Jacquard machine to pull down the needles.

2. A hold-down device according to claim 1, wherein the resilient element comprises a heald carrying a stop and a spring element held between the stop and a fixed part of the frame.

3. A hold-down device according to claim 1, wherein the spring element is a compression spring, in particular a coil spring.

4. A hold-down device according to claim 2, wherein the stop comprises a disc fixed to the heald.

5. A hold-down device according to claim 4, wherein the disc has air passage openings.

6. A hold down device according to claim 2, wherein the heald includes a first and second end and has at said first end a carabiner and at said second end an eye hook by means of which it can be releasably connected to the associated hook cord or cord assembly.

7. A hold-down device according to claim 1, wherein the resilient element is surrounded by a guide tube.

8. A hold-down device according to claim 7, wherein the guide tube has at one of its ends a perforated closure disc with a hole through which a heald can pass, and the spring element acts between a stop carried by said heald and the perforated closure disc.

9. A hold-down device according to claim 7, wherein the guide tube is held at at least one end in a fixed part of the frame and the spring element is fixed at one of its ends between said frame part and the guide tube.

10. A hold-down device according to claim 1, wherein a plurality of resilient elements are arranged as a matrix.

11. A hold-down device according to claim 10, wherein the respective ends of a plurality of guide tubes are held in perforated plates.

12. A hold down device according to claim 11, wherein the perforated plates are connected together and form, together with the resilient elements, a separable unit that can be built into the frame of the machine.

13. A hold-down device according to claim 12, wherein the guide tubes are thin-walled and a perforated support plate is provided that is located between and connected to one of the perforated plates.

14. A hold-down device according to claim 12, wherein the unit provides for predetermined pre-tensioning of the resilient elements by means of space-maintaining pieces.

* * * * *